US005106576A

United States Patent [19]

Noda et al.

[11] Patent Number: 5,106,576

[45] Date of Patent: Apr. 21, 1992

[54] METHOD OF PRODUCING A WEAR-RESISTANT COMPOUND ROLL

[75] Inventors: Akira Noda; Kenji Maruta, both of Kitakyusyu, Japan

[73] Assignee: Hitachi Metals, Ltd., Tokyo, Japan

[21] Appl. No.: 660,013

[22] Filed: Feb. 25, 1991

Related U.S. Application Data

[62] Division of Ser. No. 473,439, Feb. 1, 1990, Pat. No. 5,053,284.

[30] Foreign Application Priority Data

Feb. 2, 1989 [JP] Japan ..... 1-24540

[51] Int. Cl.[5] ..... B22F 7/00

[52] U.S. Cl. ..... 419/8; 419/11; 419/17; 419/23; 419/49

[58] Field of Search ..... 419/14, 15, 49, 60, 419/23, 8, 17, 11; 428/552; 75/239; 29/132, 110

[56] References Cited

U.S. PATENT DOCUMENTS

| | | | |
|---|---|---|---|
| 3,802,938 | 4/1974 | Collins et al. | 148/126 |
| 4,165,407 | 8/1979 | Endoh et al. | 428/408 |
| 4,966,748 | 10/1990 | Miyasaka et al. | 419/8 |
| 4,976,915 | 12/1990 | Kuroki | 419/8 |

FOREIGN PATENT DOCUMENTS

| | | |
|---|---|---|
| 58-87249 | 5/1983 | Japan . |
| 61-159552 | 7/1986 | Japan . |
| 62-7802 | 1/1987 | Japan . |
| 63-157796 | 6/1988 | Japan . |

*Primary Examiner*—Stephen J. Lechert, Jr.
*Attorney, Agent, or Firm*—Finnegan, Henderson, Farabow, Garrett & Dunner

[57] ABSTRACT

A wear-resistant compound roll having a shell portion produced by sintering a uniform mixture of alloy powder consisting essentially, by weight, of 1.2-3.5% of C, 2% or less of Si, 2% or less of Mn. 10% or less of Cr, 3-35%, as W+2Mo, of one or two of W and Mo, 1-12% of V, and balance Fe and inevitable impurities, and 1-15%, based on the weight of said alloy powder, of VC powder dispersed therein. This compound roll is produced by (a) uniformly mixing the alloy powder with the VC powder; (b) charging the resulting mixed powder into a metal capsule disposed around a roll core; and (c) after evacuation and sealing, subjecting said mixing powder to a HIP treatment.

4 Claims, 4 Drawing Sheets

100μm

METHOD OF PRODUCING A WEAR-RESISTANT COMPOUND ROLL

This is a division of application Ser. No. 07/473,439, filed Feb. 1, 1990 U.S. Pat. No. 5,053,284.

BACKGROUND OF THE INVENTION

The present invention relates to a wear-resistant compound roll suitable for hot and cold rolling and a method of producing it, and more particularly to a wear-resistant compound roll having a shell portion made of a sintered material showing excellent wear resistance and toughness, and a method of producing it.

The rolls are required to have roll surfaces suffering from little wear, little surface roughening, little sticking with materials being rolled, less cracks and fractures, etc. For this purpose, cast compound rolls having hard outer surfaces and forged steel rolls having roll body portions hardened by heat treatment, etc. are conventionally used.

Further, as rolls with extremely improved wear resistance, WC-type cemented carbide rolls produced by sintering materials containing WC and Co are used in the forms of assembled rolls. However, these rolls are expensive and need special structures for assembling. In addition, they are poor in toughness. Accordingly, they are not necessarily advantageous except for special purposes such as finish-rolling of wires.

In the rolls, a higher wear resistance is increasingly demanded, and compound rolls provided with shell portions made of alloy powders were recently proposed.

For instance, Japanese Patent Laid-Open No. 62-7802 discloses a compound roll constituted by a shell portion and a roll core, the shell portion being made from powder of high-speed steels such as SKH52, SKH10, SKH57, SKD11, etc., high-Mo cast iron, high-Cr cast iron, high-alloy grain cast iron, Ni-Cr base alloy, etc., and diffusion-bonded to the roll core by a HIP treatment.

Japanese Patent Laid-Open No. 63-33108 discloses a roll having a roll body portion whose surface is coated with a metal-ceramic composite material by a welding method, the metal-ceramic composite material comprising a metal matrix such as Fe-base heat-resistant alloys such as Cr-Fe, Cr-Ni-Fe, Cr-Ni-Co-Fe, etc., Co-base alloys such as Cr-Co, Cr-Ni-Co, etc., and Ni-base alloys such as Cr-Ni, Cr-Co-Ni, etc. and ceramic particles of WC, $Cr_3C_2$, CrC, SiC, TiC, $Si_3N_4$, $ZrO_2$, $Al_2O_3$, etc.

These rolls show improved wear resistance as compared with the conventional cast iron rolls and forged steel rolls. However, in view of the recent demand for increased wear resistance, these rolls are still insufficient.

It is expected that wear resistance can be improved by adding large amounts of carbide-forming elements to a roll material, thereby forming large amounts of high-hardness metal carbides in the roll matrix. Particularly, since vanadium carbide (VC) shows significantly higher hardness than the other metal carbides, the wear resistance of the roll can be remarkably improved by forming VC in the roll matrix.

However, mere addition of a large amount of V to the roll material results in cast rolls in which fine carbides are not precipitated, and the distribution of the precipitated carbides is not uniform. Accordingly, such cast rolls are not satisfactory from the aspect of wear resistance and resistance to surface roughening. In addition, the larger amount of V makes casting and working of the rolls more difficult.

For instance, Japanese Patent Publication No. 42-23706 discloses a cast iron containing C, Si, Ni, Co, Cr, Mo, W, V and Mn and having excellent wear resistance, in which the amount of V is 1-6%. When the amount of V exceeds 6%, castability becomes low, and the resulting alloy becomes brittle. Since the amount of V is as low as 6% or less, the cast alloy having the above composition fails to show wear resistance on the level required in hot and cold rolls.

Japanese Patent Laid-Open No. 58-87249 discloses a wear-resistant cast roll for hot strip mill having a composition consisting essentially of 2.4-3.5% of C, 0.5-1.3% of Si, 0.3-0.8% of Mn, 0-3% of Ni, 2-7% of Cr, 2-9% of Mo, 0-10% of W, 6-14% of V, 0-4% of Co, and balance Fe and inevitable impurities. Since the roll material having the above composition contains a relatively large amount of V whose upper limit is 14%, a large amount of VC is precipitated in the roll matrix, thereby providing the roll with excellent wear resistance. However, since this roll material is produced by casting, it still suffers from the problems that the particle size of VC is not sufficiently small, and that the distribution of VC is not satisfactorily uniform.

OBJECT AND SUMMARY OF THE INVENTION

An object of the present invention is, accordingly, to provide a wear-resistant compound roll having a shell portion containing fine VC particle uniformly dispersed therein, thereby showing excellent wear resistance and toughness.

Another object of the present invention is to provide a method of producing such a wear-resistant compound roll.

As a result of intense research in view of the above objects, the inventors have found that the above objects can be achieved by using a composite material comprising alloy powder containing V and VC powder. The present invention is based upon this finding.

The wear-resistant compound roll according to one embodiment of the present invention has a shell portion produced by sintering a uniform mixture of alloy powder consisting essentially, by weight, of 1.2-3.5% of C, 2% or less of Si, 2% or less of Mn, 10% or less of Cr, 3-35%, as W+2Mo, of one or two of W and Mo, 1-12% of V, and balance Fe and inevitable impurities, and 1-15%, based on the weight of the alloy powder, of VC powder dispersed therein.

The wear-resistant compound roll according to another embodiment of the present invention has a shell portion produced by sintering a uniform mixture of alloy powder consisting essentially, by weight, of 1.2-3.5% of C, 2% or less of Si, 2% or less of Mn, 10% or less of Cr, 3-35%, as W+2Mo, of one or two of W and Mo, 3-15% of Co, 1-12% of V, and balance Fe and inevitable impurities, and 1-15%, based on the weight of the alloy powder, of VC powder dispersed therein.

In these wear-resistant compound rolls, the VC powder preferably has an average particle size of 1-20 μm, and a ratio of the average particle size of the alloy powder to that of the VC powder is preferably 50 or less.

Further, the shell portion of the roll has a metal structure in which the VC powder particles selectively exist in the positions corresponding to the alloy particle surfaces.

Next, the method of producing a wear-resistant compound roll according to one embodiment of the present invention comprises the steps of (a) uniformly mixing alloy powder consisting essentially, by weight, of 1.2–3.5% of C, 2% or less of Si, 2% or less of Mn, 10% or less of Cr, 3–35%, as W+2Mo, of one or two W and Mo, 1–12% of V, and balance Fe and inevitable impurities, with 1–15%, based on the alloy powder, of VC powder; (b) charging the resulting mixed powder into a metal capsule disposed around a roll core; and (c) after evacuation and sealing, subjecting the mixed powder to a HIP (hot isostatic pressing) treatment.

The method of producing a wear-resistant compound roll according to another embodiment of the present invention comprises the steps of (a) uniformly mixing alloy powder consisting essentially, by weight, of 1.2–3.5% of C, 2% or less of Si, 2% or less of Mn, 10% or less of Cr, 3–35%, as W+2Mo, of one or two of W and Mo, 3–15% of Co, 1–12% of V, and balance Fe and inevitable impurities, with 1–15%, based on the alloy powder, of VC powder; (b) charging the resulting mixed powder into a metal capsule disposed around a roll core; and (c) after evacuation and sealing, subjecting the mixed powder to a HIP (hot isostatic pressing) treatment.

DETAILED DESCRIPTION OF THE INVENTION

Figure 1:
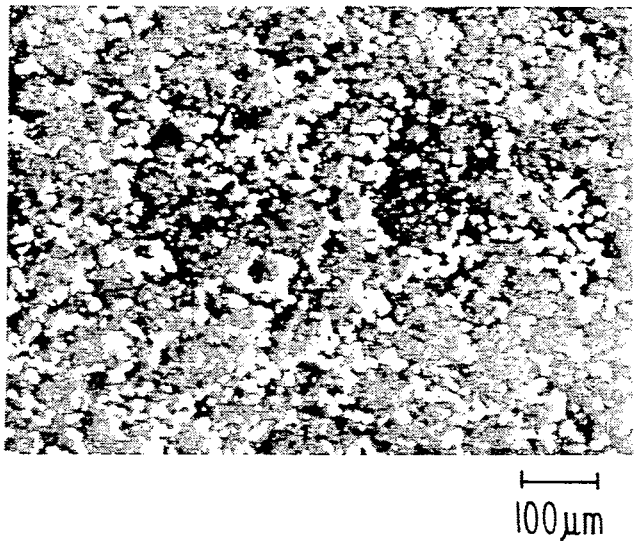
FIG. 1 is a microphotograph showing the metal structure of a sample cut out from the compound roll material according to the present invention.

The alloy powder used in the present invention is made of an alloy having a composition consisting essentially, by weight, of 1.2–3.5% of C, 2% or less of Si, 2% or less of Mn, 10% or less of Cr, 3–35%, as W+2Mo, of one or two of W and Mo, 1–12% of V, and balance Fe and inevitable impurities. This alloy may optionally contain 3–15 weight % of Co.

In these alloys, C is combined with Cr, W, Mo and V to form hard carbides, contributing to the increase in wear resistance. However, when the carbide content is excessive, too much carbides are formed, making the alloys brittle. Further, C is dissolved in the matrix to provide the function of secondary hardening by tempering. However, if C is in an excess amount, the toughness of the matrix is decreased. For these reasons, the C content is 1.2–3.5 weight %. The preferred C content is 1.2–2.3 weight %.

Si has the functions of deoxidation, hardening of the alloy matrix and improving the atomizability of the alloy. The amount of Si is 2 weight % or less. The preferred Si content is 0.2–1.0 weight %.

Mn is contained in an amount of 2 weight % or less, because it has the functions of deoxidation and increasing the hardenability of the alloy. The preferred Mn content is 0.2–1.0 weight %.

Cr not only contributes to the improvement of wear resistance by forming carbides with C but also enhances the hardenability of the alloy by dissolving into the matrix, and increasing the secondary hardening by tempering. However, when Cr is present in an excess amount, $M_{23}C_6$-type carbides increase, lowering the matrix toughness, and accelerating the gathering of carbides when tempered under the heat influence, thereby reducing the resistance to losing hardness. Accordingly, the Cr content is 10 weight % or less. The preferred Cr is 3–6 weight %, particularly 3–5 weight %.

W and Mo not only increase wear resistance by combining with C to form $M_6C$-type carbides, but also are dissolved in the matrix, thereby increasing the hardness of the matrix when heat-treated. However, when they are present in excess amounts, the toughness decreases, and the material becomes expensive. Accordingly, they are 3–35 weight %, as W+2Mo. Incidentally, in the present invention, W and Mo in equiamounts by atomic % show substantially equivalent functions. The preferred amount of W+2Mo is 7–35 weight %, particularly 10–30 weight %. Incidentally, W is preferably 3–15 weight %, and Mo is preferably 2–10 weight %.

V is combined with C like W and Mo. It forms MC-type carbides which have a hardness Hv of 2500–3000, extremely larger than the hardness Hv of 1500–1800 of the $M_6C$-type carbides. Accordingly, V is an element contributing to the improvement of wear resistance. When the V content is lower than 1 weight %, its effect is too small. On the other hand, when the V content exceeds 12 weight %, the viscosity of an alloy melt becomes too large, so that the atomization of the alloy melt becomes difficult. Although the V content may vary depending upon the amount of VC powder, a preferred amount of V is 1–7 weight %, particularly 3–7 weight %.

Co is an element effective for providing an alloy for heat resistance. However, when it is in an excess amount, it lowers the toughness of the alloy. Accordingly, Co is 3–15 weight % in the present invention. The preferred Co content is 5–10 weight %.

In the production of the alloy powder, an alloy having the above composition is melted and formed into powder by a gas atomization method, etc. The alloy powder obtained by such a method desirably has an average particle size of 30–150 μm. Since the alloy having the above composition shows a low viscosity in a molten state, it can be easily formed into powder by an atomization method.

Further, the important feature of the present invention is that the VC powder is added to the above alloy powder. The VC powder has a higher hardness and is not melted by a HIP treatment. In addition, the VC powder does not vigorously form a solid solution with the above alloy powder. The addition of the VC powder to the alloy powder serves to provide the resulting alloy material with improved wear resistance and high toughness.

Although the amount of VC precipitated can be increased by adding a larger amount of V to the alloy, it makes the atomization of the alloy melt more difficult because V increases the viscosities of an alloy melt. Therefore, the amount of V which can be added to the alloy is limited. Accordingly, V is supplemented in the form of VC in order to increase the VC in the matrix.

Figure 2:
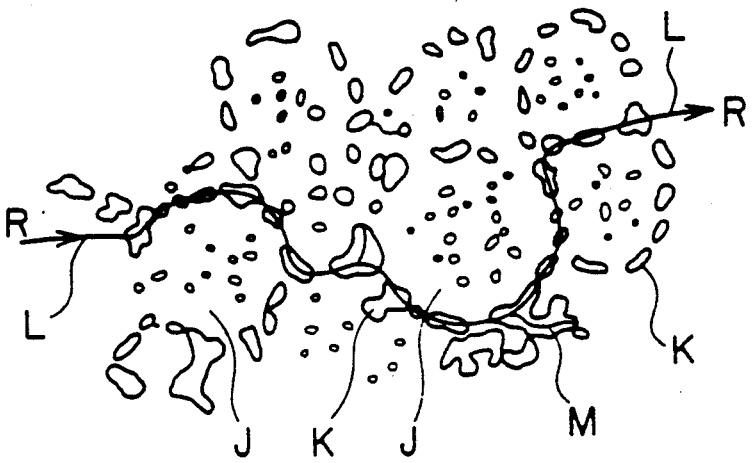
FIG. 2 is a schematic view of the metal structure in FIG. 1.

The VC powder added is uniformly distributed in the matrix in a net-work state in the positions corresponding to the alloy powder particle surfaces, as shown in FIG. 1 (microphotograph of the metal structure in the following Example) and FIG. 2 (schematic view of FIG. 1). In FIG. 2, "J" denotes the alloy particles, and "K" denotes the VC particles. In this state, when an external force is applied to the sintered material being used, the cracks "L" are generated, but the propagation of the cracks "L" is deflected by the VC particles distributed in a net-work state as shown by the arrow "R" or branched as shown by "M". By such meandering propagation of the cracks, the alloy shows high resistance to an external force, and by branched propagation of the cracks, the external force is dispersed. As a result, the alloy shows a high resistance to the propagation of cracks, thereby showing improved toughness. Thus, the addition of the VC powder serves not only to increase the amount of VC, but also to increase the toughness of the resulting alloy. Accordingly, it is possible to increase the amount of the VC powder, while decreasing the amount of V added to the alloy.

The amount of the VC powder is preferably, 1–15 weight %, based on the weight of the alloy powder. When the amount of the VC powder is too small, sufficient effects of improving wear resistance cannot be expected. On the other hand, when it is too much, the alloy becomes brittle and shows decreased toughness. The preferred amount of the VC powder is 2–12 weight %, particularly 2–10 weight %.

The VC powder desirably has an average particle size of 1–20 μm, and a ratio of the alloy powder to the VC powder in average particle size is preferably 50 or less. When the above average particle size ratio is too large, a uniform mixing of the alloy powder and the VC powder cannot be achieved, failing to uniformly disperse the VC powder in the alloy powder. As a result, the desired mechanical properties and wear resistance cannot be obtained.

By using the alloy powder and the VC powder described above in detail, it is possible to produce a compound roll having a shell portion with excellent wear resistance and mechanical properties, the shell portion being diffusion-bonded to the roll core.

Next, the method of producing the wear-resistant compound roll according to the present invention will be described.

The mixing of the atomized alloy powder and the VC powder can be conducted by any known method, but dry-mixing is preferable, and it may be conducted, for instance, by a V-type mixing machine for 3–6 hours.

Figure 3:
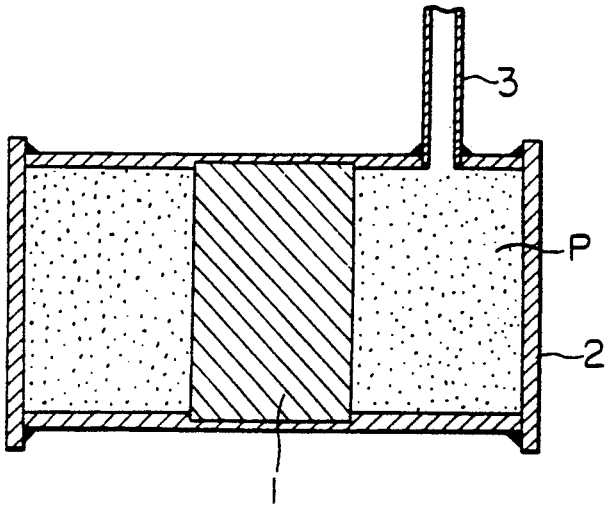
FIG. 3 is a cross-sectional view showing an apparatus for producing a wear-resistant compound roll according to the present invention.

As shown in FIG. 3, the mixed powder "P" thus obtained is charged into a metal capsule 2 disposed around a roll core 1. The metal capsule 2 is evacuated through a vent 3 provided in an upper portion thereof and sealed, to keep the inside of the metal capsule 2 in a vacuum state. It is then subjected to a HIP treatment. Incidentally, the metal capsule 2 may be made of steel or stainless steel plate having a thickness of about 3–10 mm.

The HIP treatment is usually conducted at a temperature of 1,100°–1,300° C. and a pressure of 1,000–1,500 atm in an inert gas atmosphere such as argon, etc. for 1–6 hours.

After that, the metal capsule 2 is removed by a lathe. It is then subjected to a heat treatment in the pattern shown in FIG. 4. The desired compound roll is obtained after working by a lathe.

The present invention will be described in further detail by means of the following Examples, without any intention of restricting the scope of the present invention.

EXAMPLE 1

Figure 5:
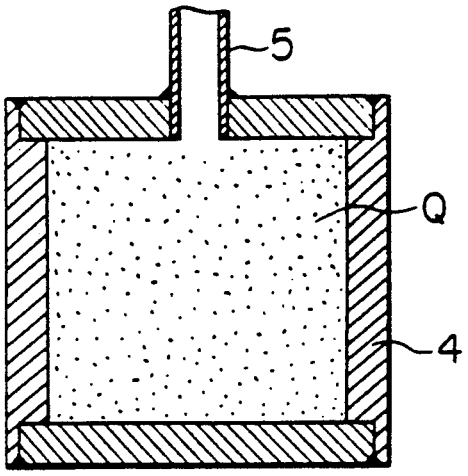
FIG. 5 is a cross-sectional view showing an apparatus for producing a sample of the roll material.

Alloy powder and VC powder having compositions shown in Table 1 were mixed by a V-type mixing machine for 5 hours. The mixed powder "Q" thus obtained was charged into a cylindrical metal capsule 4 made of SS41 steel having a diameter of 110 mm, a height of 88 mm and a thickness of 10 mm as shown in FIG. 5. The capsule 4 was evacuated through a vent 5 in an upper portion thereof while heating the overall capsule 4 at about 600° C., and the vent 5 was sealed to keep the inside of the capsule 4 at about $1\times10^{-5}$ torr. After that, this capsule 4 was placed in an argon gas atmosphere and subjected to a HIP treatment under the conditions of temperature and pressure shown in Table 1.

TABLE I

| | Example No. | | | | | Comparative Example No. | | |
|---|---|---|---|---|---|---|---|---|
| | 1 | 2 | 3 | 4 | 5 | 1 | 2 | 3 |
| Alloy Powder | | | | | | | | |
| Type(1) | B | B | A | C | C | A | B | C |
| Average Particle Size (μm) | 100 | 70 | 50 | 100 | 80 | 80 | 80 | 80 |
| VC Powder | | | | | | | | |
| Average Particle Size (μm) | 5 | 3 | 3 | 7 | 5 | — | — | — |
| Amount (Parts by weight)(2) | 3 | 6 | 9 | 12 | 15 | 0 | 0 | 0 |
| HIP Treatment | | | | | | | | |
| Temperature (°C.) | 1250 | 1250 | 1220 | 1200 | 1160 | 1220 | 1240 | 1200 |
| Pressure (atm) | 1200 | 1200 | 1000 | 1200 | 1000 | 1200 | 1200 | 1000 |

Note (1)

| Content | Alloy Powder A | Alloy Powder B | Alloy Powder C |
|---|---|---|---|
| C | 2.0 | 2.2 | 1.9 |
| Cr | 3.3 | 3.8 | 4.2 |
| Mo | 6.3 | 10.5 | 6.8 |
| W | 4.2 | 12.2 | 11.9 |
| V | 5.6 | 7.2 | 4.1 |
| Co | — | 10.2 | 9.5 |

(2)Parts by weight per 100 parts by weight of the alloy powder.

Figure 4:
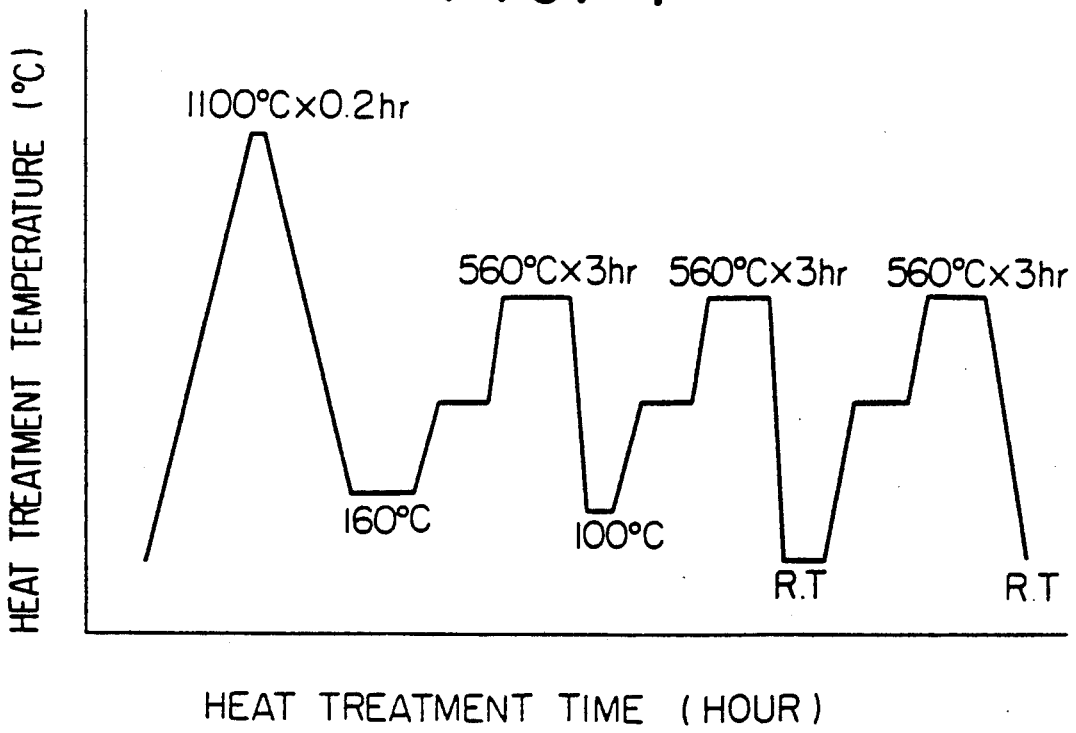
FIG. 4 is a schematic view showing a heat treatment pattern as one example of heat treatment conditions used in the production of the wear-resistant compound roll of the present invention.

After the HIP treatment, the outside capsule 4 was removed by lathing, and the resulting sample was subject to a heat treatment in the pattern shown in FIG. 4. Each sample thus obtained was cut to provide a CT (compact-tension) test piece 6 having a planar shape defined by the ASTM standards shown in FIG. 6. The test piece 6 had a size of 52 mm×50 mm×15 mm.

Figure 7:
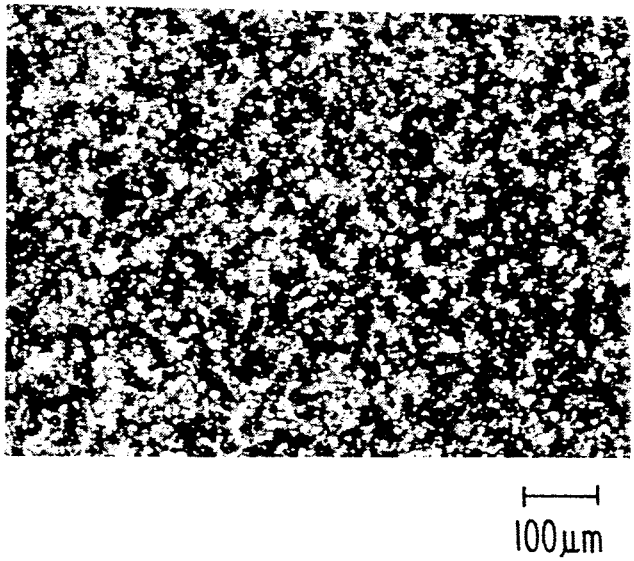
FIG. 7 is a microphotograph showing the metal structure of a conventional roll material.

The metal structure of the test piece in Example 4 is shown in FIG. 1. In FIG. 1, white portions are carbides, and the mixed VC powder particles are distributed in the positions corresponding to the alloy powder particle surfaces in a net-work state. FIG. 7 shows the metal structure in Comparative Example 3, in which the VC powder was not contained. In the case of this metal structure, the carbides distributed in a net-work state were not observed.

Figure 6:
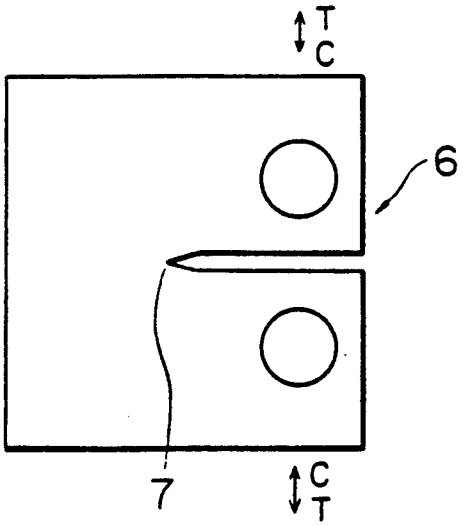
FIG. 6 is a schematic plan view showing a compact-tension test piece.

Next, each test piece 6 was subjected to tension and compression repeatedly as shown by the arrows "T" and "C" in FIG. 6 by using a servopulser (tension-compression fatigue test machine), to generate pre-cracks in a tip portion 7 of a notch of the test piece 6. The tensile rupture strength of the test piece 6 was measured by a tensile test machine, and the rupture toughness ($K_{IC}$) of the test piece 6 was calculated from the rupture strength value. The $K_{IC}$ of each test piece is shown in Table 2. Because $K_{IC}$ varies depending upon hardness, Table 2 also shows the hardness.

TABLE 2

| Sample No. | $K_{IC}$ (kgf/mm$^{3/2}$) | Hardness ($H_RC$) |
|---|---|---|
| | Example No. | |
| 1 | 53.0 | 62.7 |
| 2 | 59.5 | 62.8 |
| 3 | 60.5 | 62.6 |
| 4 | 64.5 | 62.8 |
| 5 | 63.0 | 63.0 |
| | Comparative Example No. | |
| 1 | 54.0 | 62.3 |
| 2 | 51.0 | 62.6 |
| 3 | 53.5 | 62.7 |

It is clear from these results that the test pieces of Examples show much higher $K_{IC}$ than those of Comparative Examples containing no VC powder.

EXAMPLE 2

The mixed powder obtained in the same manner as in Example 1 was charged into a capsule 2 made of SS41 steel having a thickness of 5 mm, which was disposed around a roll core 1 of SCM440 steel having a diameter of 35 mm and a length of 40 mm as shown in FIG. 3, while applying vibration. The capsule 2 was evacuated through a vent 3 disposed in an upper portion thereof, and the vent 3 was sealed. It was then subjected to a HIP treatment under the same temperature and pressure conditions as shown in Table 1 in an argon gas atmosphere.

After the HIP treatment, the capsule 2 was removed by a lathe, and the resulting sample was subjected to a heat treatment in the pattern shown in FIG. 4. After that, a surface of the shell portion was ground to provide a compound roll having a diameter of 60 mm and a length of 40 mm for a rolling wear test.

Figure 8:
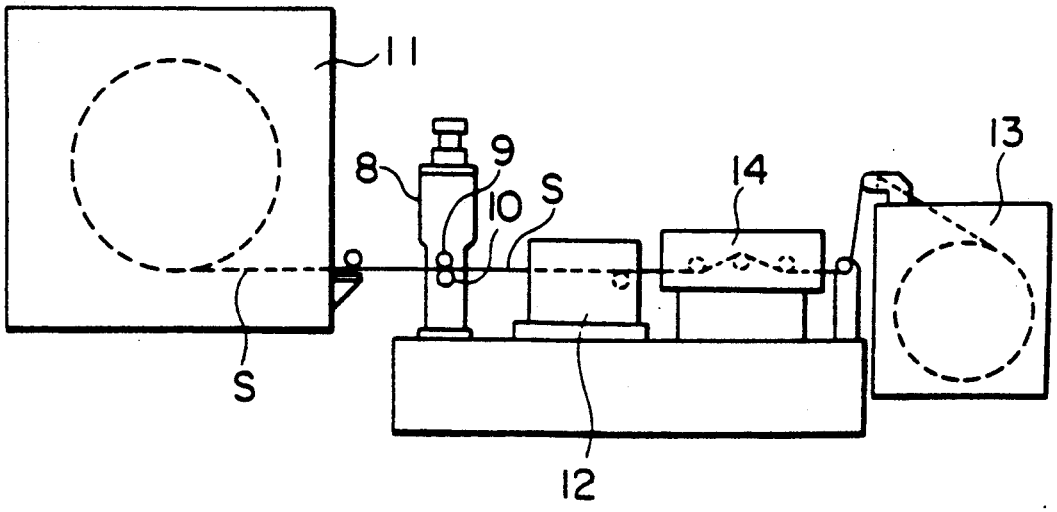
FIG. 8 is a schematic view showing an apparatus for measuring the wear resistance of the roll.

Each roll thus produced was assembled in a rolling wear test machine, and a test was conducted under the conditions shown in Table 3. The wear resistance was evaluated by measuring wear depths in surfaces of test rolls 9, 10, by a needle contact-type surface roughness tester (SURFCOM) and averaging them. Incidentally, the rolling wear test machine shown in FIG. 8 comprises a rolling mill machine 8 provided with two test rolls 9, 10, a heating furnace 11 for pre-heating a sheet "S" to be rolled, a cooling bath 12 for cooling a rolled sheet "S", a reel 13 for winding the rolled sheet and a tension controller 14.

TABLE 3

| | |
|---|---|
| Rolled Strip | SUS304 |

TABLE 3-continued

| | |
|---|---|
| Dimensions | Thickness: 1 mm, width: 15 mm, length: $2.5 \times 10^5$ mm. |
| Rolling Conditions | |
| Temperature: | 900° C. |
| Speed: | 150 m/min. |
| Reduction Ratio: | 25%. |

The test results are shown in Table 4. In Table 4, sample numbers are the same as in Table 1.

TABLE 4

| Sample No. | Average Wear Depth (μm) |
|---|---|
| | Example No. |
| 1 | 1.5 |
| 2 | 1.3 |
| 3 | 1.1 |
| 4 | 0.9 |
| 5 | 0.6 |
| | Comparative Example No. |
| 1 | 1.6 |
| 2 | 2.0 |
| 3 | 1.8 |

The compound rolls of Examples show smaller wear depths than those of Comparative Examples containing no VC powder, meaning that the compound rolls of the present invention are superior to those of Comparative Examples in wear resistance.

As described in detail, according to the present invention, the VC content in the matrix of the shell portion of the compound roll can be increased by blending an alloy powder containing V and VC powder, thereby improving the wear resistance of the resulting compound roll. In addition, in spite of the fact that a large amount of VC leads to the decrease in toughness conventionally, the compound roll of the present invention does not suffer from the decrease in toughness, and rather the toughness is increased. Further, though it was conventionally difficult to produce a sintered shell portion containing a large amount of VC from an alloy containing a large amount of V, this problem has been solved by the present invention, thereby making it possible to provide a compound roll having a sintered shell portion with excellent wear resistance.

The wear-resistance compound roll of the present invention is not restricted to the roll sizes shown in the Examples, and can be used in wide variety of applications including hot rolling mills and cold rolling mills.

What is claimed is:

1. A method of producing a wear-resistant compound roll comprising the steps of:

(a) uniformly mixing alloy powder consisting essentially, by weight, of 1.2–3.5% of C, 2% or less of Si, 2% or less of Mn, 10% or less of Cr, 3–35% of one or a mixture of materials selected from the group consisting of W and Mo, wherein the weight percentage of W and Mo, when both are present, is calculated on the basis of W+2Mo, 1–12% of V, and balance Fe and inevitable impurities, with 1–15%, based on said alloy powder, of VC powder;

(b) charging the resulting mixed powder into a metal capsule disposed around a roll core; and (c) after evacuation and sealing, subjecting said mixed powder to a HIP treatment.

2. A method of producing a wear-resistant compound roll comprising the steps of:

(a) uniformly mixing alloy powder consisting essentially, by weight, of 1.2–3.5% of C, 2% or less of Si, 2% or less of Mn, 10% or less of Cr, 3–35% of one or a mixture of materials selected from the group consisting of W and Mo, wherein the weight percentage of W and Mo, when both are present, is calculated on the basis of W+2Mo, 3–15% of Co, 1–12% of V, and balance Fe and inevitable impurities, with 1–15%, based on said alloy powder, of VC powder;

(b) charging the resulting mixed powder into a metal capsule disposed around a roll core; and (c) after evacuation and sealing, subjecting said mixed powder to a HIP treatment.

3. The method of producing a wear-resistant compound roll according to claim 1, wherein said VC powder has an average particle size of 1–20 μm, and a ratio of the average particle size of said alloy powder to that of said VC powder is 50 or less.

4. The method of producing a wear-resistant compound roll according to claim 2, wherein said VC powder has an average particle size of 1–20 μm, and a ratio of the average particle size of said alloy powder to that of said VC powder is 50 or less.

* * * * *